United States Patent [19]

Jayaraman et al.

[11] 4,432,791

[45] Feb. 21, 1984

[54] CERAMIC RADIANT TUBE HEATED ALUMINUM MELTER AND METHOD OF MELTING ALUMINIUM

[75] Inventors: Viswanath Jayaraman, Livonia; Mahendra R. Shah, Canton, both of Mich.

[73] Assignee: Holcroft & Company, Livonia, Mich.

[21] Appl. No.: 472,425

[22] Filed: Mar. 4, 1983

[51] Int. Cl.[3] ..... C21C 21/00; F27B 3/26

[52] U.S. Cl. ..... 75/65 R; 75/68 R; 266/141; 266/178; 266/200; 266/901; 432/209

[58] Field of Search ..... 266/901, 141, 178, 200; 75/68 R, 65; 432/209

[56] References Cited

U.S. PATENT DOCUMENTS

| | | | |
|---|---|---|---|
| 1,524,031 | 1/1925 | Hawke | 432/209 |
| 1,734,870 | 11/1929 | Morse | 432/209 |
| 2,068,477 | 1/1937 | Woodson | 432/209 |
| 2,200,731 | 5/1940 | Woodson | 126/91 A |
| 2,254,809 | 9/1941 | Tharaldsen | 118/419 |
| 2,331,887 | 10/1943 | Bonsack | 266/242 |
| 3,515,380 | 6/1970 | Lazaridis | 266/265 |
| 3,635,457 | 1/1972 | King | 266/900 |
| 3,996,412 | 12/1976 | Schaefer et al. | 75/68 R |
| 4,218,211 | 8/1980 | Caplan | 432/209 |
| 4,353,532 | 10/1982 | Jay | 266/901 |

*Primary Examiner*—Melvin J. Andrews
*Attorney, Agent, or Firm*—Herbert E. Messenger

[57] ABSTRACT

Disclosed are a method and apparatus for clean, low loss melting of aluminum using heat transfer by convection and radiation in separate stages. Heat input to a melter stage is provided by silicon carbide tubes into which gas-fueled burners fire so that the tubes radiate heat to a molten aluminum bath. Combustion products exiting the silicon carbide tubes pass through recuperators, preheating burner combustion air. The combustion products then are piped to a preheater stage and formed into jets of hot gases. The jets are directed into convective contact with solid aluminum stock as the stock is transported along a conveyor, preheating the stock to a temperature of about 1,000° F. The solid stock then is fed to the charge zone of the melter stage and melted by contact with the molten bath.

15 Claims, 9 Drawing Figures

CERAMIC RADIANT TUBE HEATED ALUMINUM MELTER AND METHOD OF MELTING ALUMINIUM

BACKGROUND OF THE INVENTION

This invention relates to furnace systems for melting aluminum and particularly to an arrangement wherein gas-fired burners provide both convective and radiant heating of aluminum.

Aluminum melters currently in use are generally either electric furnaces or direct fuel-fired furnaces. An example of a known type of electric aluminum melting furnace is given in U.S. Pat. No. 3,996,412, which describes a furnace using silicon carbide electrical resistance elements to radiate energy to aluminum in a heating chamber.

Direct-fired furnaces have several disadvantages. Unless chemical fluxes are added regularly to the molten aluminum baths of such furnaces, the quality of metal produced is poor because air and the products of combustion react with molten aluminum, producing gases which dissolve in the aluminum and lead to voids or inclusions in castings produced from the aluminum. Fluxes improve metal quality, but give off corrosive vapors which are an environmental hazard and may also render impractical the use of recuperators or other heat-saving devices. Direct-fired furnaces also require frequent cleaning and suffer from excessive formation of dross, resulting in metal losses of up to three to five percent.

Electrically heated aluminum melters avoid many of the above-described problems. Since they transfer heat to aluminum through radiation alone, the metal produced is clean. However, their electrical heating elements typically are quite fragile and have short lives. Also, high melting rates may be difficult to achieve in electric furnaces, and temperature recovery of their bath following input of a cold charge may be slow.

Accordingly, it is an object of the invention to provide an improved aluminum melter.

It is an object of the invention to provide an aluminum melting system which produces high quality aluminum with low metal losses and which has relatively low maintenance requirements.

It is also an object of the invention to provide an aluminum melting system wherein heat transfer is effected by both convection and radiation.

It is a further object of the invention to provide a method and apparatus for melting aluminum wherein convection and radiation heating are performed in separate sections of a melting system.

SUMMARY OF THE INVENTION

This invention concerns an aluminum melting system and method according to which aluminum stock is first preheated by jets of hot gases and then is charged into a melter whose bath is heated by radiation from ceramic tubes. The melter is of the type which usually operates with a molten bath and has a heating chamber between a charge end into which solid aluminum is introduced and a discharge opposite end from which molten aluminum is removed as product. A preheater is also included in the system as a unit separate from, but arranged to discharge into, the melter.

Heat input to the melter of the invention is provided by ceramic radiant tubes mounted in the heating chamber above the surface of the aluminum bath. Each of the radiant tubes has a gas-fueled burner at one end to fire into and along the tube and has its other end connected to a recuperator. The recuperators utilize combustion products from the burners to preheat combustion air for the burners, and the combustion products or flue gases leaving the recuperators are delivered to the preheater and forced through holes in a jet impingement plate. As solid aluminum stock is transported along the length of the preheater, as on a conveyor, hot jets of gases from the jet impingement plate above the conveyor heat the stock to a temperature such as about 750° F. The preheated solid aluminum is then directed into the charge end of the melter and melts by contact with the bath of aluminum.

In a preferred embodiment, the radiant tubes are formed of silicon carbide and many contain elements to enhance heat transfer. Also, each tube preferably is connected to its own metal recuperator.

Temperature control of the melter is achieved by regulating fuel input to the burners on the basis of aluminum temperature and through the use of an overtemperature instrument in the heating chamber. Gas temperatures in the preheater are controlled by operation of one or more valves which regulate the amount of dilution air drawn into the gas duct connecting the recuperators and the preheater.

DESCRIPTION OF PREFERRED EMBODIMENTS

A preferred aluminum melting system illustrated in FIGS. 1–6 includes a melter 20 and a stock preheater 22 which form separate, but interconnected, stages. The system is based on the concept that best overall results in melting of aluminum can be obtained by first using convection to heat solid aluminum stock to a temperature somewhat below its melting point (aluminum melts at about 1220° F.) and thereafter employing radiation to melt the aluminum in a molten bath. An additional aspect of the system is that the convective and radiant heating are performed in separate sections or stages. This avoids contact between combustion gases and molten aluminum so that metal quality is high, losses are low, and recovery of heat by recuperation is possible.

Figure 1:
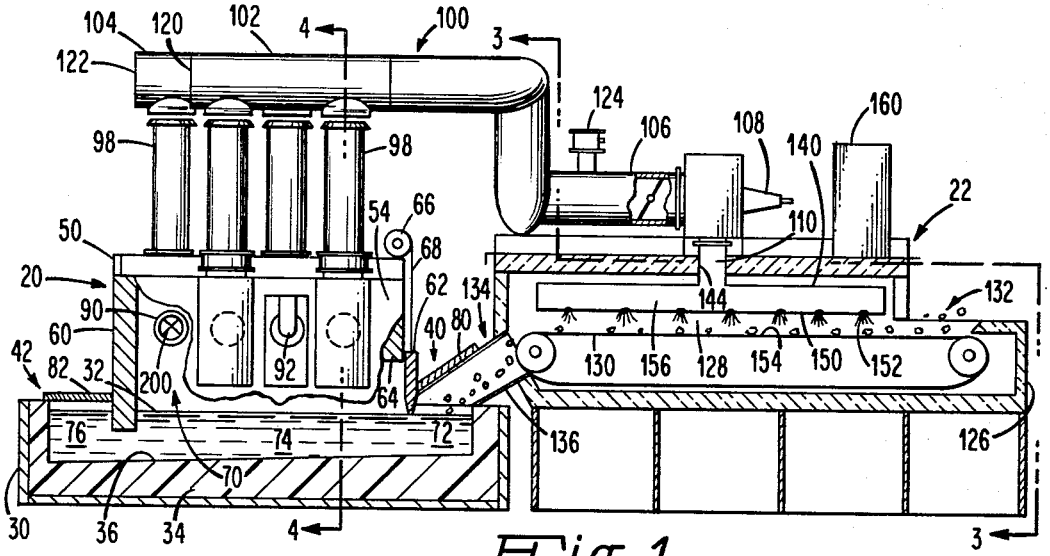
FIG. 1 is a side view, partly in section, of a preferred aluminum melting system according to the invention.
Figure 2:
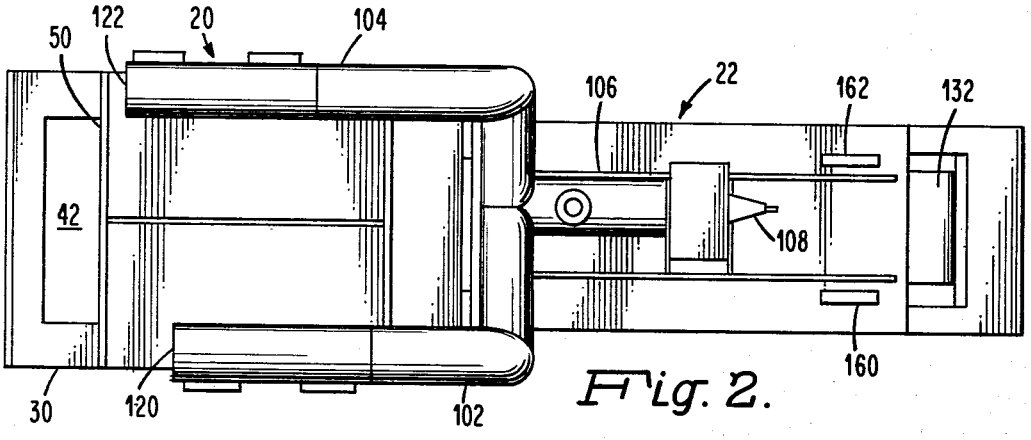
FIG. 2 is a plan view of the melting system of FIG. 1.
Figure 3:
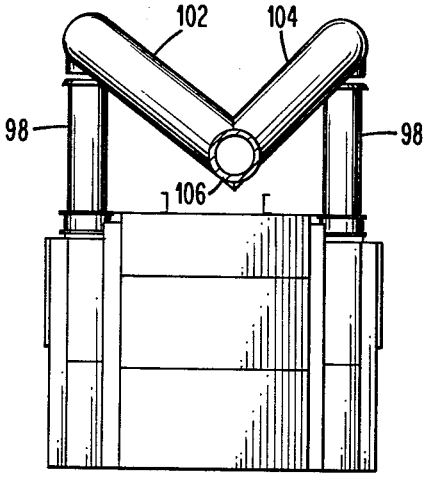
FIG. 3 is a cross-sectional view taken along the line 3—3 of FIG. 1.
Figure 4:
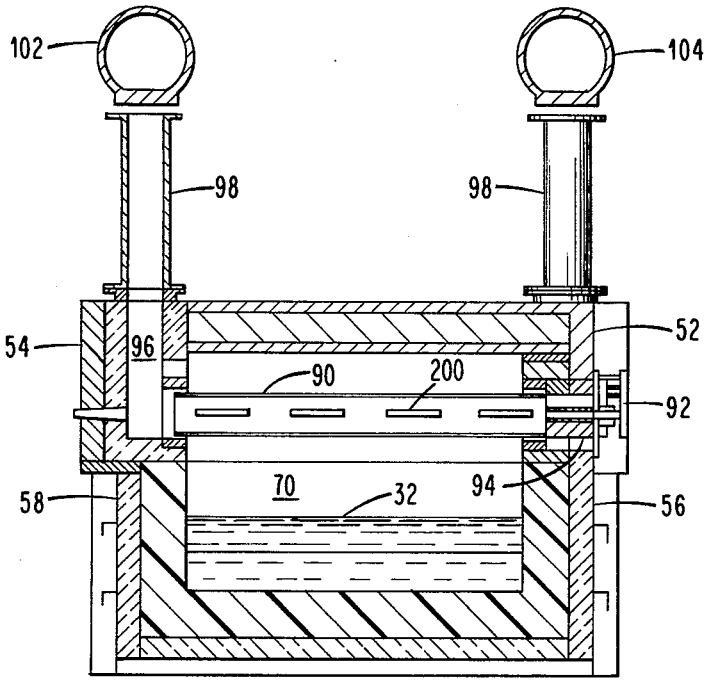
FIG. 4 is a cross-sectional view taken along the line 4—4 of FIG. 1.
Figure 5:
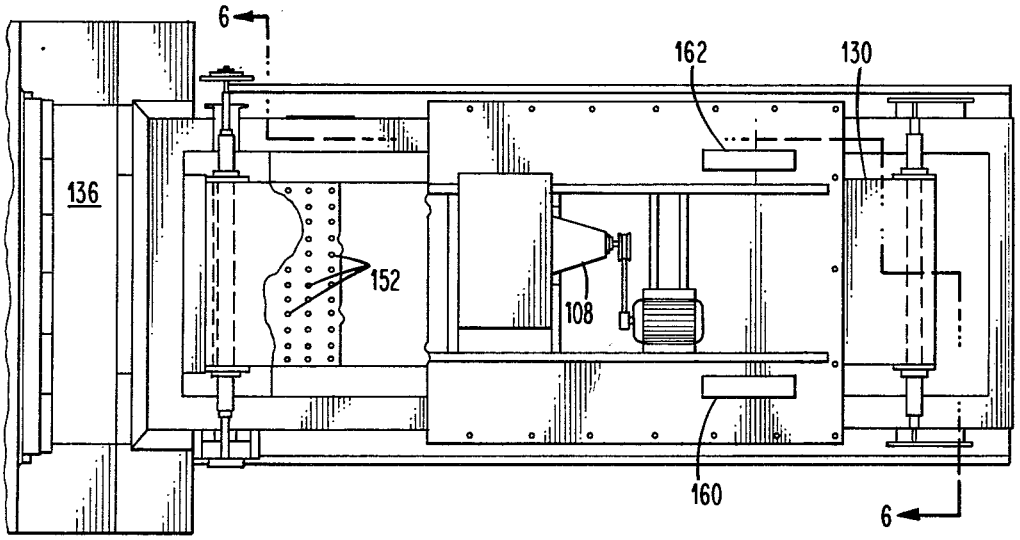
FIG. 5 is a plan view of a preferred stock preheater of the invention, with portions broken away to illustrate internal details.
Figure 6:
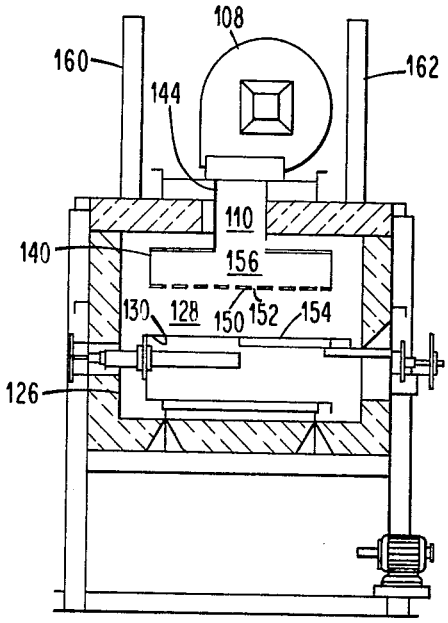
FIG. 6 is a cross-sectional view of the preheater taken along the line 6—6 of FIG. 5.

As is best shown in FIGS. 1, 2, and 4, the melter 20 includes a vessel 30 for holding a bath 32 of molten aluminum (FIG. 1). The vessel 30 may be of conventional design, including a floor 34 whose upper surface 36 slopes downward from a charge end 40 to a discharge end 42 of the melter 20. The vessel is constructed of suitable insulative, high temperature materials such as one or more layers of castable ceramics or other refractories. Vessel surfaces which contact molten aluminum during operation of the system are preferably formed of high temperature, non-wetting ceramic or plastic materials.

A roof or housing 50, also of insulative, high temperature material, comprises the upper section of the melter 20 and has sidewalls 52 and 54 which are extensions of, and integral with, the sidewalls 56 and 58 of the vessel 30. A housing endwall 60 and a door 62 adjacent to and forming an extension of an endwall 64 of the housing 50 extend downward into the molten aluminum bath 32 normally carried by the vessel 30 during melting operations. The door 62 is normally set in the position shown in FIG. 1 but is movable upward by means of a pulley 66 and a cable 68 to permit periodic inspection and cleaning of the bath and components within the housing 50.

The housing 50 thus defines therein a substantially gas-tight heating chamber 70. Also, the endwalls of the housing and vessel, together with the door 62, divide the bath 32 into a charge zone 72, a heating zone 74, and a discharge zone 76. The charge zone 72 and discharge zone 76 are topped with removable insulated covers 80 and 82, respectively, to reduce outflow of heat from, and maintain cleanliness of, aluminum held by the vessel 30.

Heat input for initial melting of aluminum in the melter 20 and for maintaining the bath 32 in a molten state is provided by internally fired ceramic radiant tubes 90 which are mounted in the heating chamber 70 of the housing 50 above the bath 32. The melting system shown in FIGS. 1–4 includes four such tube 90 extending across the chamber 70 and having ends which are supported within the sidewalls 52 and 54 of the housing 50. The tubes 90 are open-ended and preferably are of silicon carbide, which has high thermal conductivity and superior thermal shock resistance relative to other ceramic materials.

Adjacent to one end of each tube such as the tube 90 shown in FIG. 4 is a gas-fueled burner 92 whose combustion end is mounted within an opening 94 of a sidewall 52 of the housing 50 and is operable to fire a relatively long flame into and along the tube 90. Heat is transferred to the surface of the tubes 90 and the tubes in turn radiate heat to the heating chamber 70 and the molten aluminum bath 32 below the tubes.

The end of each tube opposite its associated burner 92 is connected by means of a passage 96 formed within the sidewall 54 to a recuperator 98 above the melter 20. The recuperators 98, which may be standard, high temperature metal recuperators such as model EM-65 recuperators available from Holcroft & Company of Livonia, Mich., operate in a known manner to provide heat exchange surfaces for preheating air. In the present invention, air preheated in the recuperators 98 by heat exchange with combustion products received from the tubes 90 is utilized as combustion air for the burners 92. (In the interests of clarity, the air pipes connecting each recuperator 98 to an associated burner 92 are not shown in FIGS. 1–8, but are illustrated in the flow diagram of FIG. 9.)

In a preferred arrangement, each tube 90 is connected to a separate recuperator, and the tube/burner assemblies are staggered—i.e., each burner 92 associated with any particular tube is located on a side of the melter opposite that of the burner associated with an adjacent tube. This arrangement promotes even distribution of heat within the melter 20 and facilitates a compact layout of the melting system.

To further utilize thermal energy remaining in the combustion products which have passsed through the tubes 90 and the recuperators 98, a duct and fan assembly 100 is provided above the melter 20 to direct the combustion products from the recuperators 98 into the stock preheater 22. Included in the assembly 100 are a pair of insulated ducts 102 and 104 mounted above and on either side of the melter 20. The ducts 102 and 104 have inlets spaced above the top of the recuperators 98 and are joined to a single insulated duct 106 which in turn is connected to a fan 108 mounted above an inlet 110 in the top of the stock preheater 22. Preferably, a small gap of 2–3 inches is provided between the recuperators 98 and the ducts 102 and 104 to allow for thermal growth of the recuperators 98 during operation. During operation, this gap is reduced in size but still permits inflow of a small amount of dilution air to the ducts 102 and 104 along with combustion products from the recuperators. If additional dilution air is desired to control the temperature of gases being directed to the preheater 22, such air may be admitted to the duct and fan assembly 100 through valves or movable covers (not shown) at the ends 120 and 122 of the ducts 102 and 104, respectively. Fine adjustments of dilution air may be obtained using a valve assembly 124 connected to the duct 106. The valves or covers at the duct ends 120, 122 may, in addition to providing coarse dilution control, permit venting of combustion products if operation of the system without stock preheating is desired.

The stock preheater 22, shown in FIGS. 1, 2, 5, and 6, comprises an elongated enclosure whose walls 126 may be constructed of lower temperature materials than used in the melter 20. The walls 126 define a preheat chamber 128 in which is contained a conveyor 130 or other means for transporting solid aluminum stock from an inlet or charge end 132 to a discharge end 134 of the preheater 22. An inclined discharge chute 136 connects the discharge end 134 of the preheater 22 to the charge end 40 of the melter 20 so that preheated stock may be dropped off the conveyor and gravity-fed directly into the molten bath 32 of the melter charge zone 72. If desired, a vibrator (not shown) can be added to the chute 136 to insure positive feeding of stock to the melter 20.

Mounted above the conveyor 130 and extending along a major portion of the length of the preheat chamber 128 is an elongated jet impingement structure 140 of generally rectangular cross-section. The jet impingement structure 140, which may be fabricated of mild steel plate, includes a duct section 144 which extends upward through the inlet 110 in the top of the preheater 22 and is connected to the high pressure side of the fan 108. The lower wall of the jet impingement structure 140 is a flat jet plate 150 having a multiplicity of jet holes 152 which face the conveyor surface 154 along which solid aluminum stock may be carried. During operation of the melting system, combustion products which have passed through the radiant tubes 90, the recuperators 98, and the ducts 102, 104, and 106 are directed by the fan 108 into a jet plenum 156 formed by the structure 140 and then through the holes 152 of the jet plate 150. The combustion products emerge as jets of hot gases which impinge on, and preheat, solid aluminum stock. A pair of exhaust vents 160, 162 is provided in the top of the preheater 22 near the charge end 132 to carry the spent gases out of the preheater.

Figure 7:
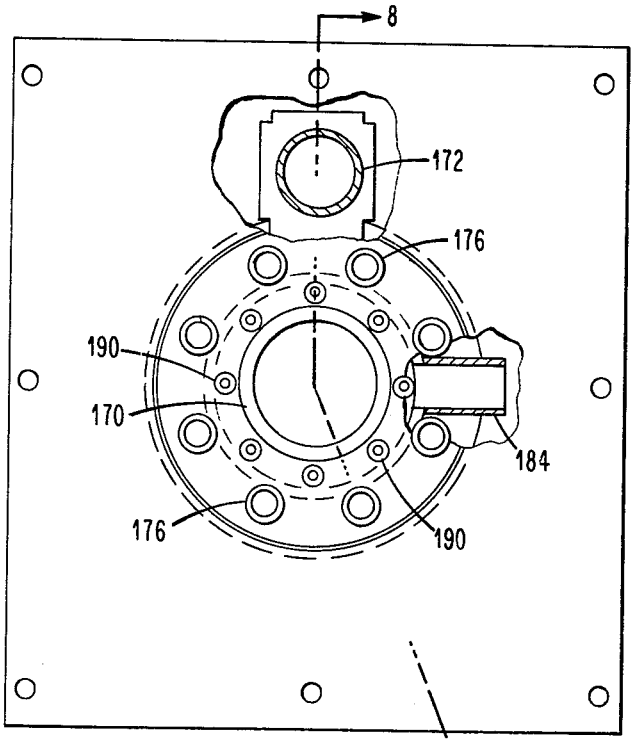
FIG. 7 is an end view, partly in cross-section and with portions broken away to illustrate additional structure, of a burner suitable for use in the melting system of the invention.
Figure 8:
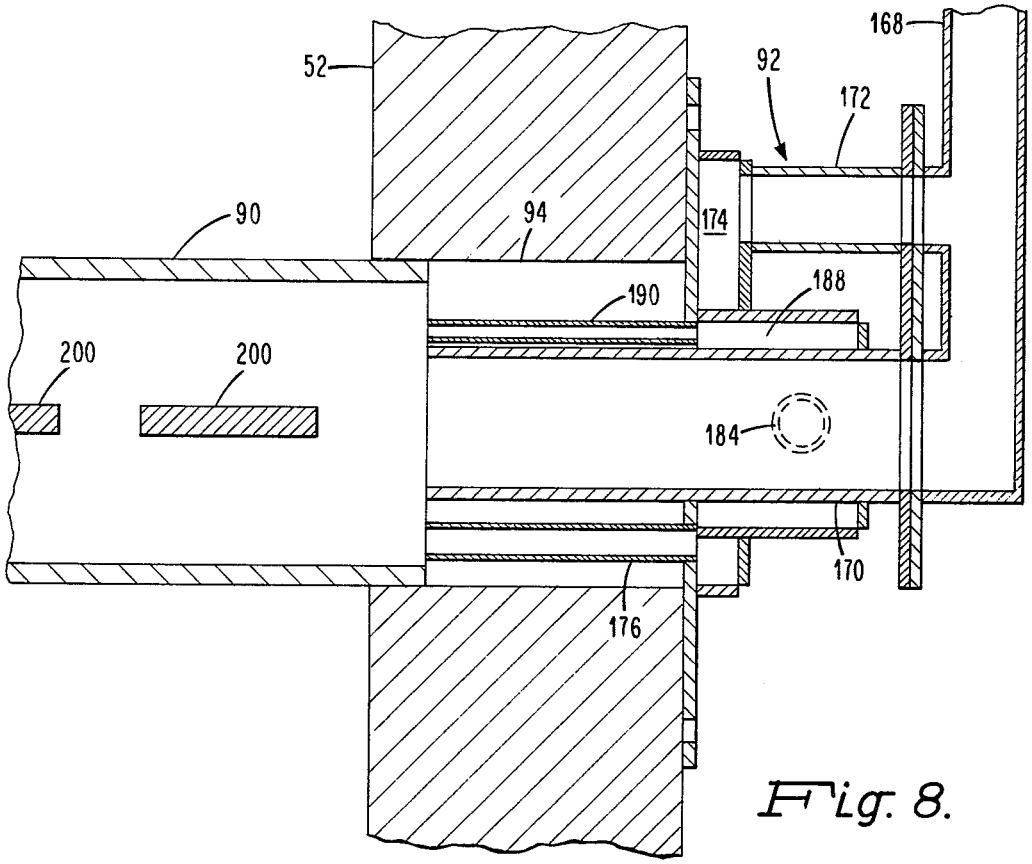
FIG. 8 is a side view of the burner of FIG. 7 taken along the line 8—8 and also showing a portion of a preferred radiant tube assembly.

FIGS. 7 and 8 illustrate the structure of a preferred gas-fired burner 92 for the melting system of the invention. The burner 92 receives preheated combustion air from one of the recuperators 98 through an air pipe 168 and directs some of the air to a central primary air tube 170. The remainder of the air is channeled through a pipe 172 into a plenum 174 and then is distributed to a circular array of secondary air tubes 176 spaced radially outward of the primary air tube 170. A single gas inlet 184 is mounted on the side of the burner 92 for receiving fuel such as natural gas from a suitable supply (not shown). The gas inlet 184 communicates by means of an annular channel 188 to a circular array of gas tubes 190 at a radial location between the primary and secondary air tubes.

The burners shown and described herein yield a long, luminous flame inside the radiant tubes 90 and release large quantities of heat. For example, a preferred burner of the type described is rated at 750,000 BTU/hr. During operation of this burner at a temperaure of 2100° F., heat release to the heating chamber 70 from tubes having approximate dimensions of 9½ inches O.D. (outer diameter), 8 inches I.D. (inner diameter), and 72 inches length, is about 25,000 BTU/hr./square foot of radiant tube surface for each tube. Greater heat release (up to about 35,000–40,000 BTU/hr./square foot) may be obtained with tubes having thinner walls. This is substantially higher than the maximum of 20,000 BTU/hr./square foot available from silicon carbide resistance heating elements used in electric furnaces.

Heating of the tubes 90 may also be enhanced by the placement therein of core busters 200 (FIGS. 1 and 8). Suitable core busters for a six foot long tube with an inner diameter of about eight inches are pieces of silicon carbide having an x-shaped cross-section with a diagonal measurement of about 7½ inches and a length of about 12 inches. The core busters 200, which fit loosely within the tubes 90, pick up heat from combustion products of the burners and radiate heat to the tubes which in turn re-radiate to the heating chamber 70 and the aluminum bath 32.

Figure 9:
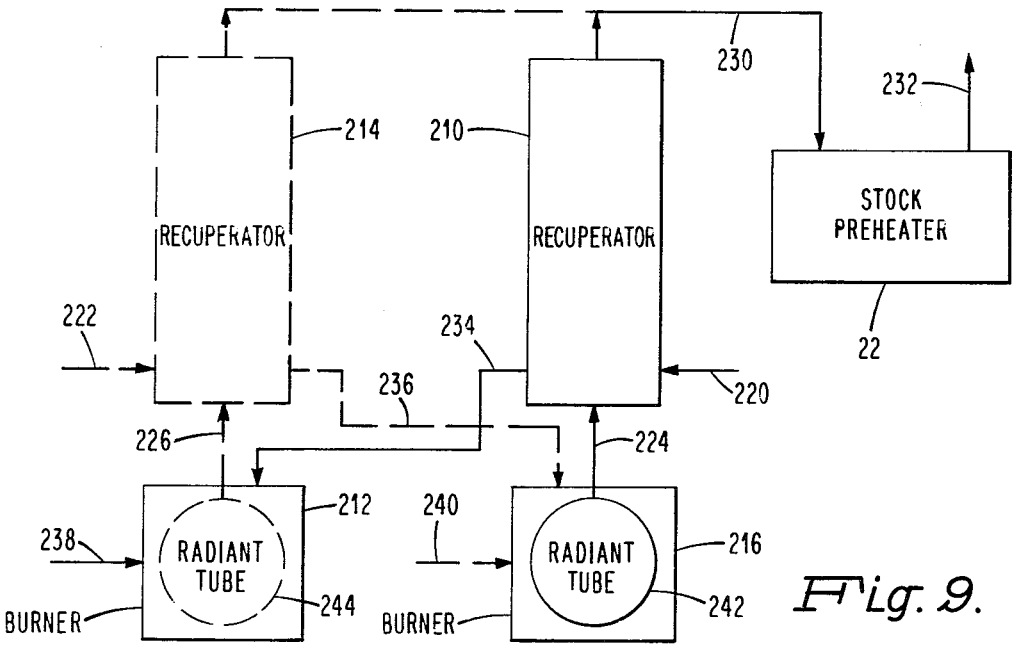
FIG. 9 is a flow diagram illustrating the flow of reactant gases and combustion products in a preferred arrangement of portions of the melting system.

FIG. 9 illustrates the flow of fuel gas, combustion air, and combustion products for a pair of adjacent burner and tube assemblies arranged in the "staggered" form referred to earlier in this disclosure. In FIG. 9 the recuperator 210 and burner 212 which are mounted on the near side of a melter such as the melter 30 as shown in FIG. 2 are indicated by solid lines, and the recuperator 214 and burner 216 mounted on the far side are indicated by broken lines. As indicated by the arrows 220 and 222, air enters the sides of the recuperators 210, 214 and is preheated as it passes in heat exchange relationship with combustion products 224, 226 flowing upward through the recuperators. The recuperators 210, 214 may each comprise a central cylinder permitting upward passage of the combustion products and two outer interconnected concentric cyclinders providing a double pass flow arrangement for air to be preheated. After passage through the recuperators, the combustion products are ducted to the stock preheater 22 as indicated by the line 230, where they convectively preheat solid aluminum stock, and then are vented (arrow 232). Preheated air from the recuperators is passed along lines 234 and 236 to the burners 212 and 216. This combustion air is then burned with fuel gas (supplied through lines 238 and 240) as the fuel/air mixture is directed along the radiant tubes 242 and 244, heating the tubes and forming combustion products which then are passed to the recuperators.

The furnace system of the invention is operated by establishing the gas flows described in the preceding paragraph and by charging solid aluminum to, and removing molten aluminum from, the system as best indicated in FIG. 1. During start-up periods, a molten bath 32 of aluminum of the desired level must first be formed in the melter 20. The bath 32 may be obtained by transferring molten aluminum from a source such as another furnace, or a solid aluminum charge may be placed in the vessel and melted by radiant heat from the tubes 90. After the molten bath 32 is formed, solid aluminum pieces are supplied at a desired rate to the charge end 132 of the stock preheater 22 and are preheated as they are transported by the conveyor 130 to the discharge end 134. Preheated solid stock falls from the conveyor 130 along the discharge chute 136 into the molten bath 32 at the charge end 40 of the melter 20 and is melted by contact with the bath. At selected intervals the cover 82 at the discharge end 42 of the melter 20 is opened and a quantity of molten (product) aluminum is removed from the bath as by ladling. The molten product may then be cast into ingots or other desired shapes.

The furnace system of the invention preferably includes various controls to regulate temperature and prevent overheating of solid aluminum in the stock preheater 22 and of molten aluminum in the bath 32. In a preferred arrangement temperature control and overtemperature protection of molten aluminum is provided by a microprocessor-based three-mode proportioning controller (not shown) which regulates fuel input to the burners 92. To avoid melting or excess softening of solid aluminum during its preheating, the temperature of combustion products entering the stock preheater 22 may be controlled to a value such as about 1000° F. by regulating the amount of dilution air drawn into the ducts 102, 104, and 106. As indicated earlier, coarse dilution control may be achieved through movable covers in the ends 120, 122 of the ducts 102, 104, and fine control may be provided by a motorized valve assembly 124 in the duct 106. If desired, an overtemperature instrument (not shown) may also be included in the stock preheater 22 and set to prevent the temperature of gases entering the preheater from exceeding a selected value such as 1025° F. A separate overtemperature instrument may also be provided to prevent overheating of the heating chamber 70 of the melter 20.

An aluminum melting system as shown and described herein has been built and tested in the melting of aluminum. The system had a nominal production rate of 1500 lb/hr of aluminum melted and heated to a pouring temperature of 1450° F. Its melter included a heating chamber about 5½ feet wide by 6¼ feet long and four nitride-bonded silicon carbide tubes of approximate dimensions 9½ inches O.D. by 8 inches I.D. by 6 feet long. Heat input to the tubes was provided by four burners each rated at 750,000 BTU/hr., and each tube was connected to a high temperaure all-metal recuperator (Holcroft model EM-65) designed to yield air preheat temperatures up to 1200° F. The stock preheater had a conveyor about 9¾ feet long by 3 feet wide and was designed to preheat solid aluminum stock to about 750° F. at rated production.

During the test period over 500,000 lbs. of aluminum was melted and poured at an average production rate of 1089 lb./hr. and average efficiency of 23.8 percent. Maximum production and efficiency values were 1496 lb./hr. and 31.4 percent, respectively. Metal quality achieved was excellent, with no reject castings attributable to the melting system, and metal loss was a low 0.83 percent of total production. This metal loss could have been lowered further had the well at the melter discharge end not been left fully open during production hours (as was done during the test period) and/or if metal had been removed from the melter by pumping or through a tap hole rather than by ladling.

In addition to producing high yields of excellent quality aluminum, the melting system which was tested required relatively little maintenance. Cleaning was required but three times over a three month period, and only one tube required replacement (for cracking) during the test period. It is believed that this tube had a manufacturing defect since the other tubes remained serviceable.

It should be pointed out that improvements in efficiency over the test values obtained can be achieved by using a longer or wider stock preheater 22 and/or operating the preheater at a higher temperature (e.g. 1150° F.). The efficiency can also be increased by using silicon carbide tubes 90 having walls thinner than the ¾ inch walls of the tubes tested. It is possible, for example, that tubes having walls as thin as 1/16 inch and fabricated by chemical vapor deposition (CVD) may be available in the future.

Thus there has been shown and described an aluminum melting system wherein convection from the combustion products of a set of gas-fired burners is used to preheat solid aluminum stock and in a separate unit the preheated solid stock is melted in a bath heated by radiation from ceramic tubes internally-fired by the burners. The system produces high quality aluminum with low metal losses and requires minimal amounts of cleaning and other service.

Although the invention has been shown and described with reference to certain preferred embodiments, it is apparent that the melting system may be embodied in other specific forms without departing from the spirit or essential characteristics of the invention. The scope of the invention is indicated by the appended claims, and all changes which come within the meaning and range of equivalency of these claims are intended to be embraced therein.

What is claimed is:

1. In an aluminum melting system including a melting vessel, a housing having endwalls submergeable in a molten aluminum bath held by said vessel during operation of the system, said housing dividing the vessel into a charge zone, a heating zone, and a discharge zone interconnected below said endwalls, and means for delivering heat to said aluminum bath in said heating zone, the improvement wherein said means for delivering heat comprises a plurality of ceramic tubes extending between opposed walls of said housing, a burner at one end of each of said tubes, said burners operable to fire hot gases into said tubes, and further including:

recuperator means for collecting the combustion products from the ends of said tubes remote from said burners and preheating combustion air for said burners by passing said air in heat exchange relationship with said combustion products; and a stock preheater operable to receive said combustion products from said recuperator means and to direct said combustion products into contact with solid aluminum stock prior to delivery of said solid stock into the charge zone of said vessel.

2. An aluminum melting system as in claim 1 wherein said ceramic tubes are formed of silicon carbide.

3. An aluminum melting system as in claim 1 wherein said stock preheater includes walls forming a preheat chamber, means for transporting solid aluminum stock from an inlet end of said preheat chamber to an outlet end of said preheat chamber, and jet impingement means spaced above said transport means for receiving said combustion products from said recuperator means and directing said products as jets into contact with solid aluminum stock carried by said transport means.

4. An aluminum melting system as in claim 3 wherein said transport means includes a conveyor and said jet impingement means comprises walls forming a jet plenum, said walls including a plate facing said surface and having a multiplicity of holes therein.

5. An aluminum melting system as in claim 4 wherein said stock preheater is positioned adjacent to said melting vessel and said melting system includes a discharge chute between the outlet end of said preheat chamber and said charge zone for directing preheated solid aluminum stock by gravity feed from the outlet end of said conveyor to said charge zone.

6. An aluminum melting system as in claim 2 wherein said silicon carbide tubes include ceramic core busters therein for transferring heat from the combustion products of said burners to said tubes.

7. An aluminum melting system as in claim 1 wherein said recuperator means includes a recuperator connected to each tube, ducting connected between said recuperators and said jet impingement means, and a fan in said ducting for delivering said combustion products under pressure to said jet plenum.

8. An aluminum melting system as in claim 7 further including means for introducing a controlled flow of dilution air into said ducting to regulate the temperature of said combustion products.

9. In an aluminum melting system including a melting vessel, a housing forming a heating chamber and having endwalls submergeable in a molten aluminum bath held by said vessel during operation of said system, said endwalls dividing said vessel into a charge zone, a heating zone, and a discharge zone interconnected below said endwalls, and means for delivering heat to said aluminum bath, the improvement wherein said means for delivering heat to said aluminum bath comprises a plurality of tubes of silicon carbide extending between opposed sidewalls of said housing and a burner mounted at one end of each of said tubes in order to fire into and heat said tubes to radiance, and further including:

a recuperator connected to the end of each said tube opposite said one end, said recuperators operable to receive combustion products of said burners after passage of said products through said tubes and to preheat combustion air for said burners by passing said air therethrough in heat exchange relationship with said combustion products;

a stock preheater positioned near said vessel and operable to preheat solid aluminum stock prior to charging of said stock into said vessel, said stock preheater including walls forming a preheat chamber, an inlet end for receiving solid aluminum stock to be preheated, an outlet end for discharging solid aluminum stock to the charge zone of said vessel, means for transporting said aluminum stock along the length of said preheat chamber from said inlet end to said outlet end, and means for directing said combustion products received from said recuperators as jets of hot gases against said solid aluminum stock; and means for delivering said combustion products under pressure from said recuperators to said stock preheater.

10. In a method of melting aluminum including providing (a) a vessel for holding molten aluminum, (b) a housing with endwalls submergeable in molten aluminum held by said vessel and dividing said vessel into a charge zone, a heating zone, and a discharge zone interconnected below said endwalls, (c) a heater for delivering heat to aluminum in said heating zone, and (d) means for loading solid aluminum stock into said charge zone and removing molten aluminum from said discharge zone, the improvement comprising:

providing, as said heater, a combustion system including one or more ceramic radiant tubes in said heating zone and burners operable to fire along the length of said tubes;

preheating combustion air for said burners by passing said air in heat exchange contact with the combustion products of said burners; and directing said combustion products into contact with said solid aluminum stock to preheat said stock prior to its entry into said charge zone.

11. A method as in claim 10 wherein said stock is preheated by passing said combustion products through a perforated plate mounted above a conveyor while transporting said stock along said conveyor towards the charge zone of said vessel.

12. A method as in claim 10 wherein said stock is preheated to a temperature in the range of about 600° F. to about 1000° F.

13. A method as in claim 10 further including controlling the temperature of said combustion products by diluting said gases with air prior to contacting said aluminum stock with said combustion products.

14. A method of melting aluminum comprising maintaining a quantity of aluminum as a molten bath by radiating heat to said bath from silicon carbide tubes fired internally by gas-fueled burners, passing the combustion products emerging from the ends of said tubes opposite said burners through recuperators to preheat combustion air for said burners, collecting the combustion products emerging from said recuperators, directing said collected combustion products into contact with solid aluminum stock to convectively preheat said stock to a temperature in the range of about 600° F. to about 1000° F., and charging said preheated solid aluminum stock into said bath to melt by contact with molten aluminum in said bath.

15. A method of melting aluminum as in claim 14 wherein said stock is preheated by passing said collected combustion products through a jet impingement structure to form jets of combustion products which are directed against said stock.

* * * * *